United States Patent [19]

Ohkado

[11] 4,288,118

[45] Sep. 8, 1981

[54] DOOR LOCK MECHANISM OF MICROWAVE OVEN

[75] Inventor: Michio Ohkado, Sakai, Japan

[73] Assignee: Sharp Kabushiki Kaisha, Osaka, Japan

[21] Appl. No.: 960,029

[22] Filed: Nov. 13, 1978

[30] Foreign Application Priority Data

Nov. 16, 1977 [JP] Japan ..... 52/155098[U]

[51] Int. Cl.[3] ..... E05C 3/06

[52] U.S. Cl. ..... 292/201

[58] Field of Search ..... 292/201, DIG. 69, 144

[56] References Cited

U.S. PATENT DOCUMENTS 3,968,983 7/1976 Heit et al. ..... 292/DIG. 69

4,082,078 4/1978 Thuleen et al. ..... 292/201 X

*Primary Examiner*—Richard E. Moore

*Attorney, Agent, or Firm*—Birch, Stewart, Kolasch & Birch

[57] ABSTRACT

A door lock mechanism having a relationship with the presence and absence of power supply to a source of heat, comprises a door switch, a door circuit activated in association with the opening and closing of the oven door, a cook circuit, first means for controlling the activation of the cook circuit, and second means responsive to the door switch for controlling the opening and closing of the oven door to thereby control the activation of the door circuit, wherein the second means is prevented by the first means from controlling the opening of the oven door while the first means is activated to provide the activation of the cook circuit.

7 Claims, 7 Drawing Figures

DOOR LOCK MECHANISM OF MICROWAVE OVEN

BACKGROUND OF THE INVENTION

The present invention relates to an oven door of a heating appliance such as a microwave oven and, more particularly, to a door lock mechanism of such a heating appliance.

In a conventional microwave oven where a door switch, a cook switch, and timer connectors were provided, the conventional microwave oven was not energized before the door switch, the cook switch, and the timer connectors were all closed. A monitor switch was needed to preclude a physical disorder of the door switch while the door switch was closed. The monitor switch shut off the power supply to the microwave oven when the door switch was out of order in the closed condition.

With the above mentioned construction, however, if the coke switch was inoperative in the closed condition and the microwave oven was being energized, the oven was in danger that the microwave energy would erroneously leak out of the microwave oven cavity when a door of the microwave oven was allowed to be open.

OBJECTS AND SUMMARY OF THE INVENTION

Accordingly, it is the primary object of the present invention to provide a simple door lock mechanism for locking and unlocking the door of a heating appliance in relationship to the presence and absence of power supply to a source of heat.

It is another object of the present invention to provide a simple door lock mechanism for a heating appliance to assure door locking for confining the generation of heating energy while the heating appliance is energized.

It is still another object of the present invention to provide a simple door lock mechanism for a heating appliance to cause locking of a door for confining the generation of heating energy while the heating appliance is energized by the activation of a door switch and a cook switch.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description. To achieve the above objects, pursuant to an embodiment of the present invention, a door lock mechanism comprises a cook switch, a lock lever, and a movable interlock lever. The cook switch is utilized for controlling the energization of a magnetron equipped within a microwave oven. The cook switch permits the energization of the magnetron in its closed position while it prevents the energization in its open position. The lock lever keeps the cook switch in the closed position. The lock lever is allowed to release the cook switch from the closed position by a door open switch.

A door latch assembly is provided for locking the closure of an oven door. The interlock lever is connected to the door latch assembly so that it unlocks the oven door in association with the door open switch.

While the cook switch is positioned in the closed position for cooking purposes, the interlock lever is prevented from moving by the cook switch.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
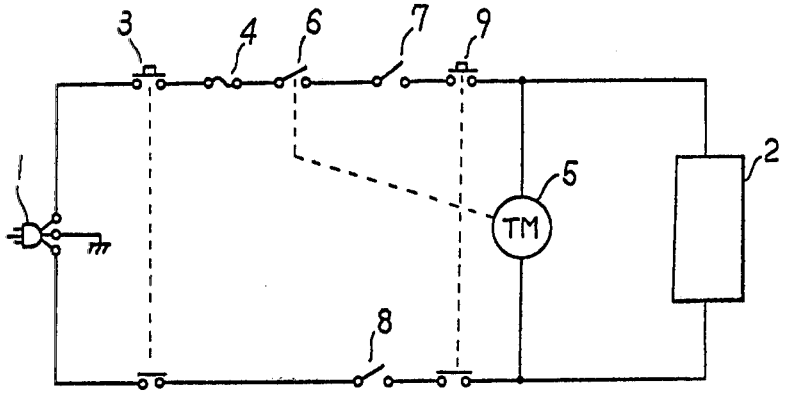
FIG. 1 is a circuit configuration of a generation circuit employed within a microwave oven of the present invention.

FIG. 1 shows a generation circuit employed within a microwave oven of the present invention where there is provided an AC plug 1, a microwave generator 2, a main switch 3, a fuse 4, a timer 5, a timer switch 6, two door switches 7 and 8, and a cook switch 9. The microwave generator 2 incluces a magnetron, a high voltage transformer, etc. The timer switch 6 is activated under the control of the timer 5. The door switches 7 and 8 are controlled in accordance with the opening and closure of a door of the microwave oven. The cook switch 9 is closed under pressure for cooking purposes. The microwave generator 2 is allowed to receive AC power energy from the AC plug 1 when the main switch 3, the timer switch 6, the door switches 7 and 8, and the cook switch 9 are all closed.

Figure 2:
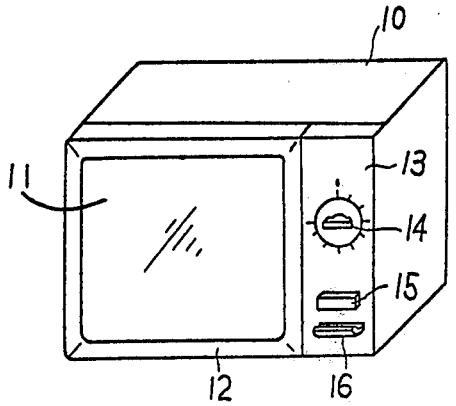
FIG. 2 is a perspective view of the microwave oven of the present invention.

FIG. 2 illustrates the microwave oven 10 having a door lock mechanism of the present invention. The mircowave oven 10 comprises an oven cavity 11, a door 12, a control panel 13, a timer knob 14, a cook switch knob 15, and a door open knob 16. The timer knob 14 is utilized for setting the timer 5 in a desirable time. The cook switch knob 15 is provided for closing the cook switch 9 under pressure. Under pressure the door open knob 16 is activated to open both the door 12 and the cook switch 9.

Figure 3:
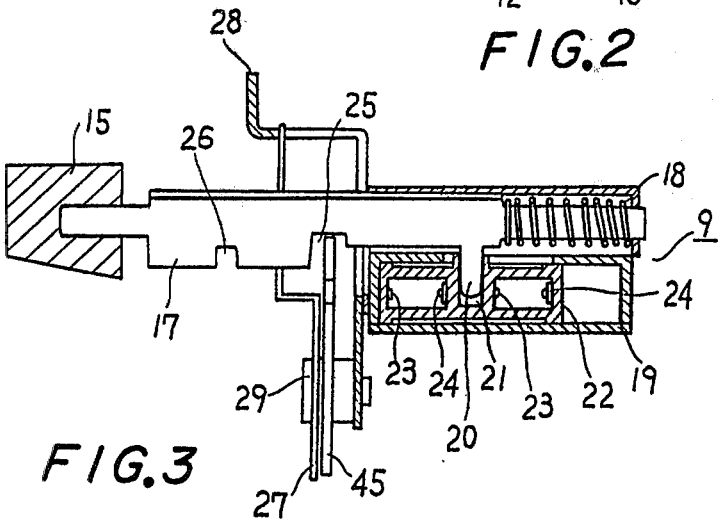
FIG. 3 is a cross-sectional view of a cook switch employed within a door latch mechanism according to the present invention.
Figure 4:
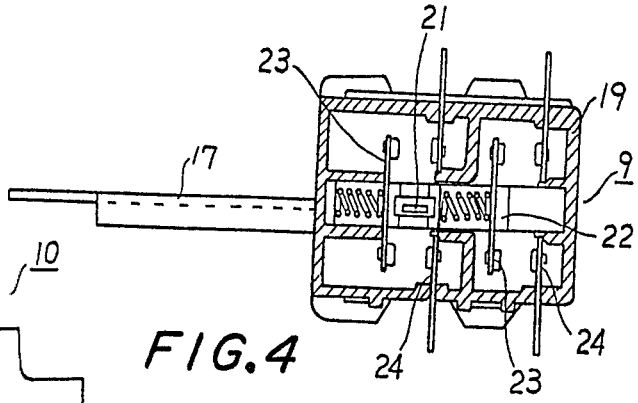
FIG. 4 is a sectional view of the cook switch of FIG. 3 showing a plane view of the interior mechanism.

Before considering the operation of the door lock mechanism of the present invention, the cook switch 9 is described in detail. FIGS. 3 and 4 illustrate the cook switch 9 in a cross-sectional view and a sectional view showing the interior from the top, respectively.

A switch lever 17 is continuously urged forward by a spring 18 to tend to fix the cook switch knob 15 in the top of the switch lever 17. The switch lever 17 is moved backward toward the interior of a switch housing 9 by pressure applied to the cook switch knob 15. A projection portion 20 formed on the switch lever 17 is engaged with a first recession 21 of a movable body 22. As the switch lever 17 moves backward, the movable body 22 is also shifted backward. Therefore, the movable terminals 23 arranged on the movable body 22 move towards the two fixed terminals 24. The movable terminals 23 come into contact with the fixed terminals 24 just before the switch level 17 reaches the inmost portion of the switch housing 9. This means that the cook switch 9 shown in FIG. 1 is closed. Second and third recesses 25 and 26 are further formed in the switch lever 17. A lock lever 27 is engaged with the third recession 26 when the movable terminals 23 are in engagement with the fixed terminals 24. Even after the cook switch knob 15 is free from pressure, the switch lever 17 is locked against the spring 18 in the innermost position by the engagement of the third recession 26 with the lock lever 27. The switch lever 17 is not unlocked until the lock lever 27 releases the engagement between the third recession 26 and the lock lever 27. The lock lever 27 is rotatably secured by a shaft 29 mounted in a fixed plate 28.

Figure 5:
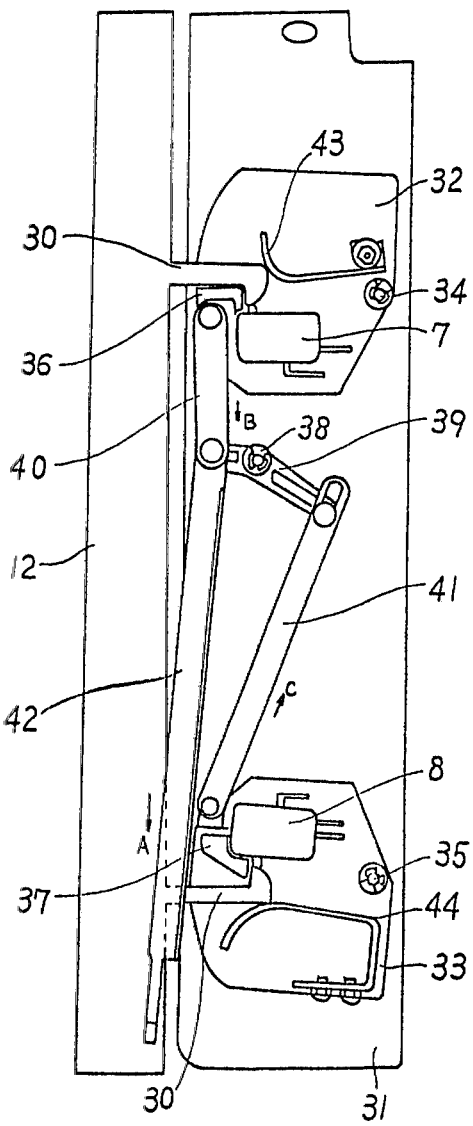
FIG. 5 is a side view of a door latch mechanism of the present invention.

FIG. 5 illustrates in a side view a door latch assembly adapted to the present invention for locking the door 12 in the closed condition. A pair of door hooks 30 is secured on the upper and lower portions of the door 12, respectively. The door hooks 30 extend toward the body of the microwave oven 10 while a latch substrate 31 is installed within the body of the microwave oven 10 so that a pair of latch hooks 32 and 33 face the door hooks 30 for engaging purposes. The latch hooks 32 and 33 are rotatably secured around shafts 34 and 35, respectively.

The respective latch hooks 32 and 33 have the door switches 7 and 8 shown in FIG. 1 each comprising, for example, a microswitch. Furthermore, the latch hooks 32 and 33 have hook members 36 and 37, respectively, which engage with the door hooks 30 in response to the closing of the door 12. There is also provided a hook lever 39, and a pair of levers 40 and 41 for connecting the latch hooks 32 and 33. The hook lever 39 is rotatably secured on a shaft 38 upright in the latch substrate 31. A latch lever 42 is further connected to extend downward to the connection between the hook lever 39 and the lever 40. When the latch lever 42 is drawn in a direction A under the closure of the door 12, the levers 40 and 41 move toward directions B and C, respectively.

This movement results in counter-clockwise rotation of the upper latch hook 32 and clockwise rotation of the lower latch hook 33. The door hooks 30 are allowed to disconnect from the hook members 36 and 37, respectively. Thereafter, the tips of plate springs 43 and 44 push the door hooks 30 outward to thereby open the door 12 a bit. The plate springs 43 and 44 are fixed on the latch hooks 32 and 33, respectively. In FIG. 5 the plate springs 43 and 44 function to ensure engagement of the door hooks 30 with the hook members 36 and 37. Upon the opening of the door 12 using the latch lever 42, on the other hand, the latch springs 43 and 44 serve to push the door hooks 30 from the hook members 36 and 37 outwardly.

Upon closure of the door 12 which is manually pressed, for example, the door hooks 30 are engaged with the hook members 36 and 37 against the plate springs 43 and 44. Meanwhile, the door switches 7 and 8 are closed by the tips of the door hooks 30.

Figure 6:
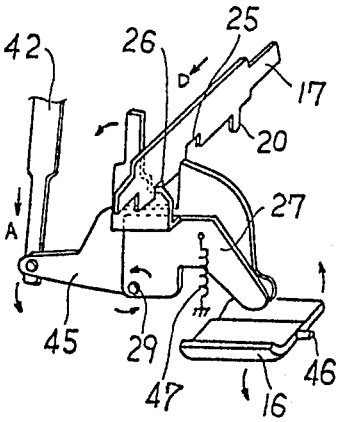
FIG. 6 is a perspective view of a fundamental assembly adapted to the present invention.

FIG. 6 illustrates in a perspective view a significant assembly of the door lock mechanism of the present invention. The significant assembly is positioned below the latch lever 42. An interlock lever 45 is rotatably held by the shaft 29 of the fixed plate 28. One end of the interlock lever 45 is confronted against the door open knob 16. During the closure conditions of the door 12, the switch lever 17 is pressed against the cook switch 9 to thereby permit the lock lever 27 to engage with the third recession 26 of the switch lever 17 at the inmost portion by the force impressed by a spring 47 as previously mentioned. The switch lever 17 is locked by the lock lever 27.

When the door open knob 16 is depressed to open the door 12, the door open knob 16 is rotated about a shaft 46. Since lock lever 27 is in contact with the door open knob 16 at the one end thereof, the lock lever 27 is rotated in the counter-clockwise direction against the tension of the spring 47 at the earlier stage of the rotation of the door open knob 16.

The switch lever 17 is released from the lock lever 27 in response to the rotation of the lock lever 27. The switch lever 17 is shifted forward, (comma) to extend outwardly from the surface of the control panel, by the tension of the spring 18 of FIG. 3. This results in the separation between the movable terminals 23 and the fixed terminals 24 to thereby open the cook switch 9.

Figure 7:
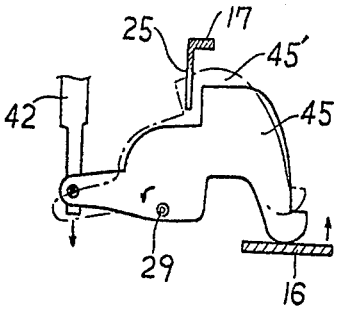
FIG. 7 is a side view of an interlock lever illustrating its operations.

As the switch lever 17 is moved forward, the second recess 25 reaches the interlock lever 45. From the middle stage of the rotation of the door open knob 16, as illustrated in FIG. 7, the interlock lever 45 is rotated in the counter-clockwise direction by the door open knob 16 to thereby pull down the latch lever 42. The shifted latch lever 42 permits the door latch mechanism to be released as described with reference to FIG. 6. The downward movement of the latch lever 42 allows the door switches 7 and 8 to open and the plate springs 43 and 44 to press the door 12 outward to open the door.

As viewed from the drawings of FIGS. 3, 6 and 7 the interlock level 45 is rotatable as far as the second recess 25 of the switch lever 17 is positioned at the location where the interlock lever 45 is arranged. If the movable terminals 23 of the cook switch 9 are prevented from separating from the fixed terminals 24 due to the combination therebetween because of dissolving, the switch lever 17 can not be shifted even though the door open knob 16 is activated to rotate the lock lever 27 in the counter-clockwise direction in order that the third recession 26 is spaced from the lock lever 27.

Therefore, the interlock lever 45 is pevented from rotating by the switch lever 17 because the second recess 25 of the switch lever 17 is not arranged at the position where the interlock lever 45 is allowed to rotate. This means that the door open knob 16 is also prevented from rotating and the door 12 is not allowed to open. An operator for the microwave oven 10 can detect the cook switch 9 out of order. The microwave energy does not erroneously leak out of the oven cavity 11.

While the door 12 is in the open position, the interlock lever 45 is maintained by the latch lever 42 to engage with the second recess 25 of the switch lever 17 as viewed in FIG. 7 e.g. the interlock lever denoted as 45' is positioned the area depicted by the broken line. The interlock 45' prevents the switch lever 17 from moving backward, thereby restricting the movable terminals 23 to come into contact with the fixed terminals 24. The microwave generator 2 is not erroneously energized when the microwave energy is supplied under the open condition of the door 2.

Upon the closure of the door 12, the door hooks 30 are connected to the hook member 36 and 37 to pull up the lactch lever 42 in the reverse direction of the direction A. Therefore, the interlock lever 45 is rotated in the clockwise direction to permit the switch lever 17 to be released from the interlock lever 45 as depicted by the solid line of FIG. 7. Then the switch lever 17 can be moved rearwardly.

While only certain embodiments of the present invention have been described, it will be apparent to those skilled in the art that various changes and modifications may be made therein without departing from the spirit and scope of the invention as claimed.

What is claimed is:

1. A lock mechanism for an oven generation circuit comprising:

a door switch being controlled by the opening and closing of an oven door;

a cook switch which may be activated when said oven door is in the closed position;

a generation circuit operatively connected to a power source, a heat generating source, said door switch and said cook switch;

said heat generating source being power supplied by the activation of both the door switch and the cook switch;

first means for controlling the activation of the cook switch; and second means responsive of a door opening mechanism for controlling the opening and closing of the oven door, thereby controlling the activation of the door switch;

wherein the second means is prevented by the first means from controlling the opening of the oven door while the first means is activated to provide the activation of the heat generating source.

2. A lock mechanism according to claim 1, wherein the first means includes an engagement portion, and the second means is engaged to the engagement portion to control the opening of the door with the exception that the second means is pevented by the first means from controlling the opening of the oven door when said first means is activating said cook switch.

3. A lock mechanism according to claim 1, wherein said first means is further provided with a latch member for locking the first means while the first means activates said cook switch and for releasing the same in response to the door opening mechanism.

4. A lock mechanism according to claim 3, wherein the first means includes an engagement portion, and said latch member is engaged to the engagement portion to lock the first means when said cook switch is activated.

5. A lock mechanism for a microwave oven generation circuit comprising:

a door switch being controlled by the opening and closing of an oven door;

a cook switch which may be activated when said oven door is in the closed position for activating a microwave energy source;

a lockable switching means controlling the switch-on condition of the cook switch;

a locking means for controlling the closing and opening of the oven door and the door switches;

a generation circuit operatively connected to a power source, said microwave energy source, said door switch and said cook switch;

said heat microwave source being power supplied by the activation of both the door switch and the cook switch;

said lockable switching means for said cook switch prevents the release of said locking means for said oven door and said door switch as long as the cook switch is closed and the microwave energy source may still be activated.

6. A lock mechanism according to claim 5, wherein a locking lever is connected with said locking means said locking lever abutting against a movable part of said switching device for blocking the release of said locking means and the opening of the door as long as the cook switch is closed.

7. A lock mechanism according to claim 6, wherein said switch device includes a switch lever by which the cook switch may be activated and which blocks a rotation movement of said locking lever for releasing the door locking as long as the cook switch is closed.

* * * * *